US009908690B2

(12) United States Patent
Rosenkrantz-Theil

(10) Patent No.: US 9,908,690 B2
(45) Date of Patent: Mar. 6, 2018

(54) PACKAGE FOR EGGS

(75) Inventor: Torben Rosenkrantz-Theil, Oakville (CA)

(73) Assignee: BRØDRENE HARTMANN A/S, Gentofte (DK)

( * ) Notice: Subject to any disclaimer, the term of this patent is extended or adjusted under 35 U.S.C. 154(b) by 167 days.

(21) Appl. No.: 14/396,191

(22) PCT Filed: Apr. 26, 2012

(86) PCT No.: PCT/IB2012/052098
§ 371 (c)(1),
(2), (4) Date: Jun. 12, 2015

(87) PCT Pub. No.: WO2013/160733
PCT Pub. Date: Oct. 31, 2013

(65) Prior Publication Data

US 2015/0291346 A1 Oct. 15, 2015

(51) Int. Cl.
*B65D 1/24* (2006.01)
*B65D 1/36* (2006.01)
(Continued)

(52) U.S. Cl.
CPC ..... *B65D 85/327* (2013.01); *B65D 85/324* (2013.01); *B65D 85/325* (2013.01)

(58) Field of Classification Search
CPC .... B65D 85/32; B65D 85/324; B65D 85/327; B65D 85/325; A47G 19/03; A47G 19/06
(Continued)

(56) References Cited

U.S. PATENT DOCUMENTS 3,207,409 A 9/1962 Reifers et al.
3,343,660 A * 9/1967 Bailey ..... B65D 5/64 229/114
(Continued)

FOREIGN PATENT DOCUMENTS

EP 2301359 3/2011

OTHER PUBLICATIONS

International Preliminary Report on Patentability, for PCT/IB2012/052098, dated Jul. 15, 2014.
(Continued)

*Primary Examiner* — Andrew T Kirsch
(74) *Attorney, Agent, or Firm* — Marvin Petry; Stites & Harbison PLLC

(57) ABSTRACT

The invention pertains to an egg package comprising: a bottom part (4) formed by suction molding of a fibrous material, the bottom part (4) comprising a rear side (28), a front side (30), two end sides (32), and a plurality of egg-receiving compartments (34) having non-planar side surfaces (35) so as to match at least partially the outer contours of an egg, the plurality of compartments (34) being arranged in at least two parallel rows with upwardly extending projections (36) located between the rows of compartments (34), a cover part (6) comprising two substantially planar end surfaces (10), substantially planar rear (48) and front surfaces (12), and a substantially planar top surface (14), said cover part (6) being formed by cardboard and connected to the bottom part (4) via an elongated flap (40) extending from the rear side (28) of the bottom part (4), said elongated flap (40) being provided with a weakening in the transition between said elongated flap (40) and rear side (28) of the bottom part (4), said weakening forming a hinge (50) so as to allow the cover part (6) to move between an open position and a closed position, said elongated flap (40) at
(Continued)

least in part overlapping the inner side (42) of said rear surface (48) of the cover part (6), said bottom part (4) comprising a retainment flap (44) hinged to the front side (30) of the bottom part (4), said retainment flap (44) comprising at least one outwardly extending retainment projection (26) for locking engagement with one or more cooperating apertures (46) in the front surface (12) of the cover part (6), said cover part (6) further comprising a substantially flat display surface (16) formed in the region between the top surface (14) and front surface (12) of the cover part (6), said substantially flat display surface (16) meeting the top surface (14) at a first obtuse angle, thereby forming a first edge (18), and said substantially flat display surface (16) meeting the front surface (12) at a second obtuse angle, thereby forming a second edge (20). The invention also pertains to a kit of parts comprising a bottom part for an egg package and a blank of cardboard material comprising preformed cutting and folding lines, the blank being configured such that, when cut and folded along said cutting and folding lines, it forms a cover for said bottom part.

10 Claims, 5 Drawing Sheets

(51) Int. Cl.

| | |
|---|---|
| ***B65D 25/04*** | (2006.01) |
| ***B65D 57/00*** | (2006.01) |
| ***B65D 85/00*** | (2006.01) |
| ***B65D 85/32*** | (2006.01) |
| ***A47G 19/03*** | (2006.01) |
| ***A47G 19/06*** | (2006.01) |

(58) Field of Classification Search
USPC ..... 220/508
See application file for complete search history.

(56) References Cited

U.S. PATENT DOCUMENTS

| | | | | |
|---|---|---|---|---|
| 3,362,605 | A | 1/1968 | Bixler | |
| 3,550,836 | A | 12/1970 | Macchi | |
| 3,836,067 | A * | 9/1974 | Andersson | B65D 85/324 206/521.9 |
| 4,462,537 | A * | 7/1984 | Grootherder | B65D 85/32 206/505 |
| 7,232,054 | B2 * | 6/2007 | Yocum | B65D 5/4204 206/459.1 |
| 8,494,208 | B2 | 7/2013 | Fordham | |

OTHER PUBLICATIONS

Written Opinion of the International Searching Authority, for PCT/IB2012/052098, dated Jun. 3, 2013.
International Search Report, for PCT/IB2012/052098, dated Jun. 3, 2013.
Written Opinion of the International Preliminary Examining Authority, for PCT/IB2012/052098, dated Apr. 3, 2014.

* cited by examiner

PACKAGE FOR EGGS

TECHNICAL FIELD

The present invention pertains to an egg package wherein the bottom part is formed by suction moulding of a fibrous material, and the cover part is formed from a different material.

BACKGROUND OF THE INVENTION

Packages of the above kind are for example known from U.S. Pat. No. 3,550,836 wherein an egg package is disclosed, which comprises a bottom part formed from a fibrous material, the bottom part comprising a rear side, a front side, two end sides, and a plurality of egg-receiving compartments having non-planar side surfaces so as to match at least partially the outer contours of an egg, the plurality of compartments being arranged in at least two parallel rows with upwardly extending projections located between the rows of compartments.

Said egg package further comprises a cover part comprising two substantially planar end surfaces, substantially planar rear and front surfaces, and a substantially planar top surface, said cover part being formed by chipboard and being connected to the bottom part via an elongated flap extending from the rear part of the bottom part, said elongated flap being provided with a hinge in the transition between said elongated flap and the rear part of the bottom part so as to allow the cover part to move between an open position and a closed position, said elongated flap at least in part overlapping the inner side of said rear surface of the cover part.

The bottom part further comprises a retainment flap hinged to the front side of the bottom part, said retainment flap comprising at least one outwardly extending retainment projection for locking engagement with two co-operating apertures in the front surface of the cover part.

Mostly, the bottom part and cover part are being constructed in such a way that the inner and outer surfaces of the bottom part as well as the inner surfaces and outer surfaces of the cover part are complementary, so that when the egg package is fully open, it may be nested with other, identical egg packages for shipment and/or storage. Usually, the egg packages are formed in such a way that one fully open egg package fits within the egg package immediately preceding it in a stack. This kind of stacking of egg packages is a very compact way of stacking egg packages together, and this way of stacking egg packages together is usually referred to as nesting.

Molded pulp is desirable for production of an egg package because it can be shaped to conform to a desired degree to the configuration of the eggs, and also at the same time it has the adequate softness to constitute appropriate cushioning support for the eggs and to offer desired shock resistance. However, while the rough and fuzzy surface of the moulded pulp normally used for egg cartons is partly responsible for this beneficial cushioning effect, this same rough and fuzzy surface is not receptive for lithographic decoration of multiple colours or other printing.

Additionally, moulded pulp has an inherent softness in the material, which therefore may lead to inadequate support of the eggs during transport, by handling in packaging machinery, and by manual handling in for example a supermarket. However, although the egg package disclosed in the above-mentioned US patent has a cover made of chipboard, which inherently is stiffer than moulded pulp, its construction is of such a form that it does not provides an adequate stiffening support for the bottom part of the egg package.

In addition to egg packages formed of a fibrous material, such as pulp, several attempts to manufacture egg packages from plastic have been proposed. For example in EP 2 301 359 is disclosed an egg package made from plastic.

SUMMARY OF THE INVENTION

It is thus an object of the present invention to provide an egg package which at the same time provides adequate cushioning for the eggs to be placed in it, and having a sufficient stiffness to be handled quickly and in an error free manner.

It is furthermore an object of the present invention to provide an egg package, which may be easily decorated and customized to the needs of the individual egg producer.

According to the present invention, the above-mentioned and other objects are fulfilled by an egg package comprising the following main parts:

- a bottom part formed by suction moulding of a fibrous material, the bottom part comprising a rear side, a front side, two end sides, and a plurality of egg-receiving compartments having non-planar side surfaces so as to match at least partially the outer contours of an egg, the plurality of compartments being arranged in at least two parallel rows with upwardly extending projections located between the rows of compartments,
- a cover part comprising two substantially planar end surfaces, substantially planar rear and front surfaces, and a substantially planar top surface,
- said cover part being formed by cardboard and being connected to the bottom part via an elongated flap extending from the rear part of the bottom part, said elongated flap being provided with a weakening in the transition between said elongated flap and rear part of the bottom part, said weakening forming a hinge so as to allow the cover part to move between an open position and a closed position, said elongated flap at least in part overlapping the inner side of said rear surface of the cover part,
- said bottom part comprising a retainment flap hinged to the front side of the bottom part, said retainment flap comprising at least one outwardly extending retainment projection for locking engagement with one or more co-operating apertures in the front surface of the cover part,
- said cover part further comprising a substantially flat display surface being formed in the region between the top surface and front surface of the cover part, wherein said substantially flat display surface meets the top surface at a first obtuse angle, thereby forming a first edge, and wherein said substantially flat display surface meets the front surface at a second obtuse angle, thereby forming a second edge.

When manufacturing egg packages, a number of factors constrains or limits the freedom of the design. These factors are inter alia that the egg-receiving compartments must be of such a size and shape that they can accommodate a standard egg. Additionally, the outer dimensions of the egg package must be of such a size and shape that they can be used in standard egg-packaging machines presently used in the industry. However, within these design constraints there is by the present invention achieved an egg package, wherein the bottom part made of moulded fibrous material provides a sufficient cushioning effect for the eggs to be transported in said egg package, and wherein the cover part made of cardboard provides sufficient rigidity for the egg package for ensuring safe handling of the egg packages without the significant risk of breaking the eggs within said package.

Since the substantially flat display surface meets the top surface at a first obtuse angle, thereby forming a first edge, and since the substantially flat display surface meets the front surface at a second obtuse angle, thereby forming a second edge, it is possible to close the cover part by egg packaging machinery because, when the cover part is pivoted with respect to the hinge and moved from its open to its closed position, then the front surface will slide over the at least one outwardly extending retainment projection on the retainment flap until said retainment projection engages the one or more co-operating apertures in the front surface of the cover part, thereby closing and locking the cover part. This error-free handling of the egg package by packaging machinery is important because eggs and egg packages are handled at a tremendous speed by packaging machinery.

Furthermore, since the cover is made of cardboard, it has a surface that may easily be decorated and customized to the needs of the individual egg producer. Such decoration may be lithographic or text printed directly on the cover part. Compared to pulp or other fibrous material, cardboard is much easier to decorate with printed text and other decorations in any desirable color.

Moreover, since the substantially flat display surface meets the top surface at a first obtuse angle, thereby forming a first edge, and the substantially flat display surface meets the front surface at a second obtuse angle, thereby forming a second edge, it is achieved that the substantially flat display surface will be in the immediate line of vision of a person holding the egg package in his hands. Thus, any message written on this display surface will be more conspicuous than a message on any other surface of the cover part. A consumer in a supermarket is constantly bombarded with messages in written and lithographic form, and is usually also very busy. Thus, it is of a tremendous advantage that an important message about the product (the eggs) can be conveyed to the consumer in a simple and conspicuous way, e.g. as a buss word like "Vegetarian feed", "Organic", "Omega 3", etc., thereby enabling the consumer to take a split-second decision on whether or not to buy the product.

In a preferred embodiment, the first and second edges have a curved shape. In a further preferred embodiment of the egg package according to the invention, the first and second edges meet at a first and second corner of the cover part. Preferably, the first edge curves upwardly, and the second edge curves downwardly.

In order to enhance the conspicuousness of the substantially flat display surface, this may in a further embodiment be provided with a physical feature representing the contents of the egg package, said physical feature extending beyond the substantially flat display surface. The physical feature may partly be formed by a cutout from the top surface of the cover part. This is a practical way of achieving facilitation of said physical feature. The physical feature may also or alternatively be partly formed by a cutout from the front surface of the cover part In a further embodiment, the physical feature is formed as a two-dimensional representation of any of the following agricultural products: An egg, one or more egg shells, or a hen.

Preferably, said physical feature is customized, whereby it will be possible for individual egg producers to distinguish themselves from other producers in a more conspicuous way.

In a further embodiment of the egg package according to the invention, the inner or outer side of the top surface may be provided with a recipe and perforations around the recipe. Hereby is achieved an embodiment, wherein the consumer can easily remove the recipe from the cover part and save it for later use.

In a preferred embodiment, the elongated flap is connected to the inner side of the rear surface of the cover part by an adhesive.

According to a further preferred embodiment, the bottom part may be moulded as one piece together with another similar bottom part, the two bottom parts being connected via the elongated flap. Hereby a simple way of manufacturing the bottom parts may be achieved, which requires a minimum degree of modification of already existing manufacturing equipment, because the part of the moulding form that is used to manufacture the cover part in traditional egg packages may simply be exchanged with another form for the bottom part according to the invention. Preferably, the bottom part is made of moulded pulp.

In order to save material for the cover part, it is desirable to use as thin a cardboard as possible, also because a thinner cardboard is more easily machine-handled into its desired shape. Thus, in order to provide an optimal trade-off between this and the need for a desired rigidity, the cover of an egg package of the above-mentioned kind, i.e. one that is made of cardboard material, may be too soft to support layers of additional egg packages filled with eggs arranged on top of each other. Without the upwardly extending projections located between the rows of compartments to support the cover when the egg package is closed, the weight of the additional egg-filled egg packages will rest on the eggs of the lower packages in the stack, which may then break during storage and transport. Thus, according to a preferred embodiment of an egg package according to the invention, the inner side of the top surface rests on the top of the upwardly extending projections of the bottom part when the cover is in the closed position.

According to a further preferred embodiment of the invention, the elongated flap is configured for abutting an egg within the egg package, and the retainment flap is configured for abutting another egg within the egg package. Hereby sufficient cushioning of the eggs is achieved, even along the back and front surfaces of the cover part.

In a further embodiment of the invention, the outwardly extending retainment projection is tapered, whereby it is achieved that it eases the closing and locking of the cover part, because the cover front surface of the cover part (during closing) will then slide over the retainment projection, whereby it will gradually bulge outwards until said projection(s) engage the co-operating aperture(s) in the front surface of the cover part, whereupon the front surface of the cover part bulges back (due to the inherent rigidity of the cover material) to its original position and form, thereby keeping the cover closed.

In order to ensure a safe and reliable locking of the cover part, the position, shape and size of the one or more co-operating apertures in the front surface of the cover part may according to a further embodiment correspond to the position, shape and size of the outwardly extending retainment projection.

In a further embodiment of the invention, the cover part is provided with a graphical and/or pictorial information which is directly printed on said cover part. Preferably, the cover part may be customized. According to one embodiment of the egg package according to the invention, the graphical and/or pictorial information which is directly printed on said cover part is customized.

In a further embodiment of the egg package according to the invention, the apertures in the front surface of the cover part are placed adjacent to the second edge. Hereby a safer and more reliable locking of the cover part is facilitated because the front surface of the cover part is more stiff in the region adjacent to the second edge.

In a further embodiment of the egg package according to the invention, the substantially flat display surface forms a panel which is bounded and enclosed by the first and second edges and wherein the first edge curves upwardly and the second edge curves downwardly, the first and second edges meeting or intersecting each other at a first and second corner of the cover part.

According to the present invention, the above-mentioned and other objects are also fulfilled by a kit of parts comprising:

a bottom part of an egg package, said bottom part being formed by suction moulding of a fibrous material and comprising a rear side, a front side, two end sides, and a plurality of egg-receiving compartments having non-planar side surfaces so as to match at least partially the outer contours of an egg, the plurality of compartments being arranged in at least two parallel rows with upwardly extending projections located between the rows of compartments, said bottom part comprising a retainment flap hinged to the front side of the bottom part, said retainment flap comprising at least one outwardly extending retainment projection for locking engagement with one or more co-operating apertures in a front surface of a cover part, a blank of cardboard material comprising preformed cutting and folding lines, the blank being configured in such a manner that, when cut and folded along said cutting and folding lines, it forms:

a cover part for said bottom part of an egg package, said cover part comprising two substantially planar end surfaces, substantially planar rear and front surfaces, and a substantially planar top surface, said cover part being formed by folding the cardboard blank and being connectable to the bottom part via an elongated flap extending from the rear part of the bottom part, said elongated flap being an integrally moulded part of said bottom part and being provided with a weakening in the transition between said elongated flap and rear part of the bottom part, said weakening forming a hinge so as to allow the cover part to move between an open position and a closed position, said elongated flap at least in part overlapping the inner side of said rear surface of the cover part, said cover part being formed by folding the cardboard blank further comprising a substantially flat display surface formed in the region between the top surface and front surface of the cover part, wherein said substantially flat display surface meets the top surface at a first obtuse angle, thereby forming a first edge, and wherein said substantially flat display surface meets the front surface at a second obtuse angle, thereby forming a second edge.

In an embodiment of the kit of parts according to the invention, the first and second edges of the cover part have a curved shape when the cardboard blank is cut and folded along the cutting and folding lines.

In a further embodiment of the kit of parts according to the invention, the first and second edges of the cover part meet at a first and second corner of the cover part when the cardboard blank is cut and folded along the cutting and folding lines.

In a further embodiment of the kit of parts according to the invention, the substantially flat display surface is provided with a physical feature representing the contents of the egg package, said physical feature extending beyond the substantially flat display surface and partly being formed by a cutout from the top surface of the cover part.

In a further embodiment of the kit of parts according to the invention, the physical feature is formed as a two-dimensional representation of any of the following agricultural products: an egg, one or more egg shells, or a hen.

In a further embodiment of the kit of parts according to the invention, the inner or outer side of the top surface is provided with a recipe and perforations in the cardboard blank around the recipe.

In a further embodiment of the kit of parts according to the invention, the elongated flap is to be connected to the inner side of the rear surface of the cover part by an adhesive.

In a further embodiment of the kit of parts according to the invention, the bottom part is moulded as one piece together with another similar bottom part, the two bottom parts being connected via the elongated flap.

In a further embodiment of the kit of parts according to the invention, the bottom part is made of moulded pulp.

In a further embodiment of the kit of parts according to the invention, the inner side of the top surface of the cover part is configured so as to rest on the top of the upwardly extending projections of the bottom part when the cardboard blank is cut and folded into a cover part, which is connected to the bottom part and placed in the closed position.

In a further embodiment of the kit of parts according to the invention, the elongated flap is configured for abutting an egg within the egg package, and the retainment flap is configured for abutting another egg within the egg package.

In a further embodiment of the kit of parts according to the invention, the outwardly extending retainment projection is tapered.

In a further embodiment of the kit of parts according to the invention, the position, shape and size of the one or more co-operating apertures in the front surface of the cover part correspond to the position, shape and size of the outwardly extending retainment projection when the cardboard blank is cut and folded along the cutting and folding lines.

In a further embodiment of the kit of parts according to the invention, the cardboard blank is provided with a graphical and/or pictorial information which is directly printed on said cardboard blank.

In a further embodiment of the kit of parts according to the invention, the cardboard blank is customized.

In a further embodiment of the kit of parts according to the invention, the graphical and/or pictorial information which is directly printed on the cardboard blank is customized.

In a further embodiment of the kit of parts according to the invention, said physical feature is customized.

In a further embodiment of the kit of parts according to the invention, the substantially flat display surface forms a panel which is bounded and enclosed by the first and second edges, said first edge curving upwardly and said second edge curving downwards, the first and second edges meeting or intersecting each other at a first and second corner of the cover part when the cardboard blank is cut and folded along the cutting and folding lines.

In another embodiment of the egg package according to the invention, the outer surface of the bottom part may be substantially smoother than the inner surface of the bottom part. This will provide an egg package which is easier to produce than if both the inner and outer surfaces have to be smoothened, and which at the same time may be easily mechanically de-nested without error.

The above-mentioned surface smoothness may for example be achieved by an after pressing of the freshly moulded—and thereby still wet—egg packages during the manufacturing process.

BRIEF DESCRIPTION OF THE DRAWINGS

A further understanding of the nature and advantages of the present invention may be realized by reference to the remaining portions of the specification and the drawings.

In the following, preferred embodiments of the invention are explained in more detail with reference to the drawings, wherein.

DETAILED DESCRIPTION

Figure 1:
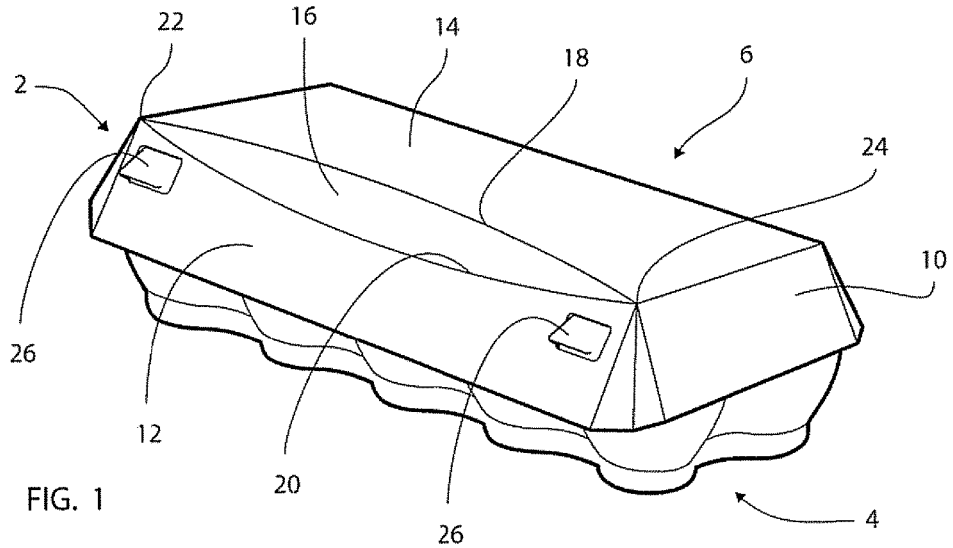
FIG. 1 shows a perspective illustration of an embodiment of an egg package according to the invention.

The present invention will now be described more fully hereinafter with reference to the accompanying drawings, in which exemplary embodiments of the invention are shown. The invention may, however, be embodied in different forms and should not be construed as limited to the embodiments set forth herein. Rather, these embodiments are provided so that this disclosure will be thorough and complete, and will fully convey the scope of the invention to those skilled in the art. Like reference numerals refer to like elements throughout. Like elements will, thus, not be described in detail with respect to the description of each figure.

FIG. 1 is a perspective illustration of an embodiment of an egg package 2 according to the invention. The illustrated egg package 2 comprises a bottom part 4 and a cover part 6. The bottom part 4 is formed by suction moulding of a fibrous material, preferably pulp, and the cover part 6 is formed by cardboard. The cover part 6 comprises two substantially planar end surfaces 10 (of which only one is shown), substantially planar rear (not shown) and front surfaces 12, and a substantially planar top surface 14.

The illustrated cover part 6 further comprises a substantially flat display surface 16 formed in the region between the top surface 14 and front surface 12 of the cover part 6, wherein said substantially flat display surface 16 meets the top surface 14 at a first obtuse angle, thereby forming a first edge 18, and wherein said substantially flat display surface 16 meets the front surface 12 at a second obtuse angle, thereby forming a second edge 20.

In the illustrated embodiment, the first and second edges 18, 20 have a curved shape, and they meet at a first 22 and second 24 corner of the cover part 6. The first edge 18 curves upwardly and the second edge 20 curves downwardly.

Also shown in FIG. 1 are the outwardly extending retainment projections 26 for locking engagement with co-operating apertures in the front surface 12 of the cover part 6 for locking the cover part 6.

Figure 2:
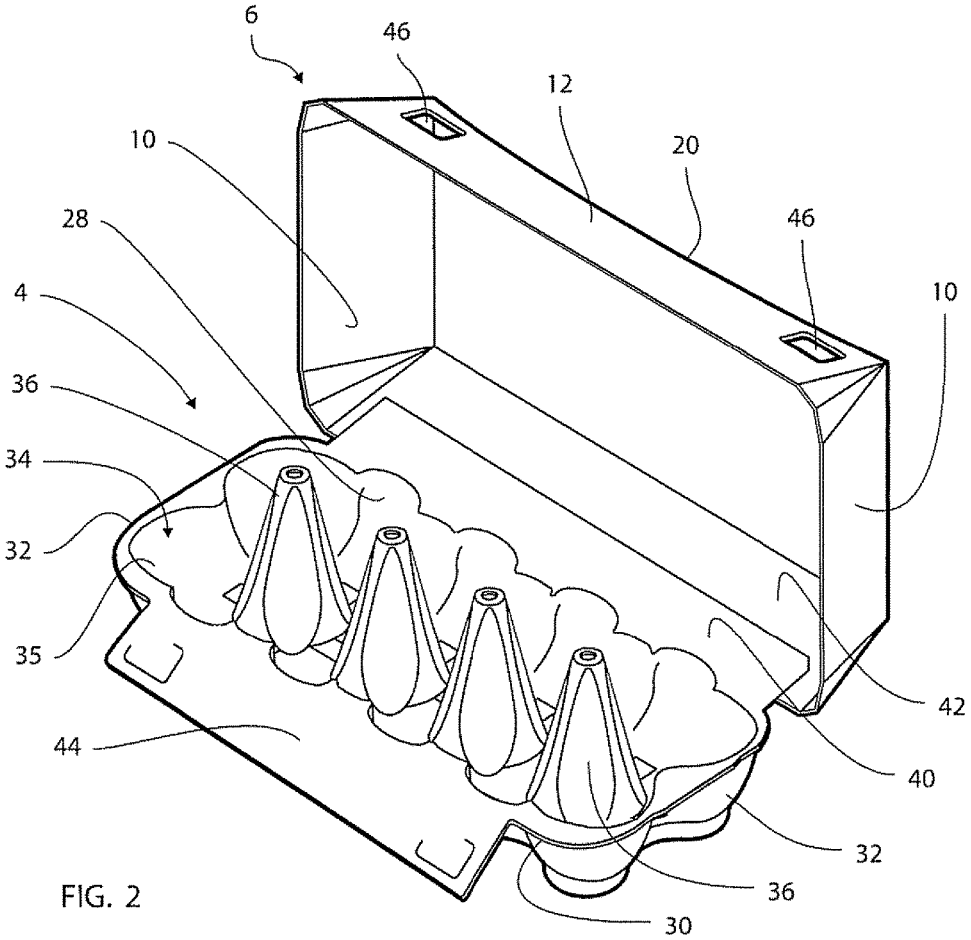
FIG. 2 shows the same embodiment of an egg package as illustrated in FIG. 1, but now in a state wherein the cover is open.

FIG. 2 shows the same embodiment of an egg package 2 as illustrated in FIG. 1, but now in a state wherein the cover 6 is open. In this figure is more clearly shown that the bottom part comprises a rear side 28, a front side 30, two end sides 32, and a plurality of egg-receiving compartments 34 having non-planar side surfaces 35 so as to match at least partially the outer contours of an egg, the plurality of compartments 34 being arranged in at least two parallel rows. Between said rows of compartments there are provided a plurality of upwardly extending projections 38.

The cover part 6 is connected to the bottom part 4 via an elongated flap 40 extending from the rear side 28 of the bottom part 4. The elongated flap 40 at least in part overlaps the inner side 42 of said rear surface of the cover part 6.

The bottom part 4 comprises a retainment flap 44 hinged to the front side 30 of the bottom part 4. The illustrated retainment flap 44 further comprises two outwardly extending retainment projections 26 for locking engagement with two co-operating apertures 46 in the front surface 14 of the cover part 6.

The apertures 46 in the front surface 12 of the cover part 6 are placed adjacent to the second edge 20. Hereby is facilitated a safer and more reliable locking of the cover part 6, because the front surface 12 of the cover part 6 is more stiff in the region adjacent to the second edge 20.

Figure 3A:
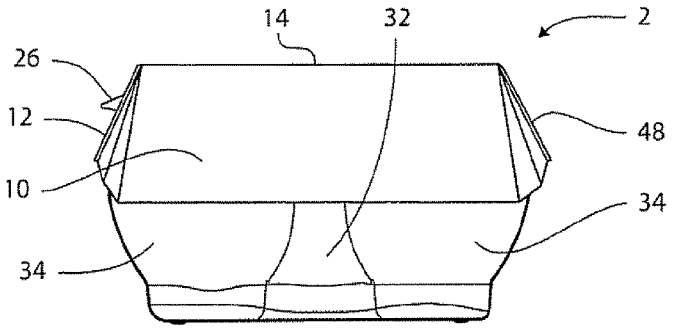
FIG. 3A shows an end view of an egg package with a closed cover.

FIG. 3A illustrates an end view of the egg package 2 with the cover part 6 in its closed position. In this end view, the rear surface 48 of the egg package 2 is more clearly visible.

Figure 3B:
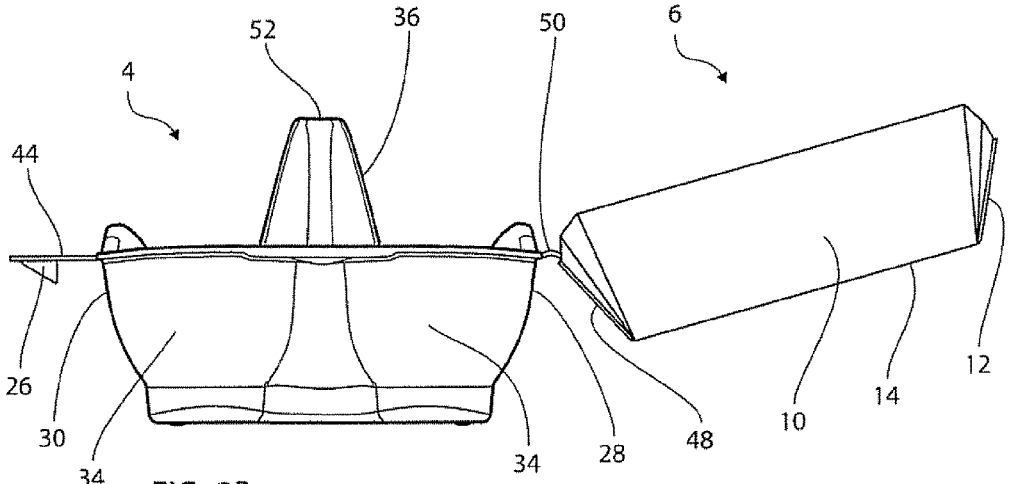
FIG. 3B shows an end view of an egg package with an open cover.

FIG. 3B illustrates an end view of the egg package 2 with the cover part 6 in its open position. The elongated flap 40 is provided with a weakening in the transition between said elongated flap 40 and rear part 28 of the bottom part 4, said weakening forming a hinge 50 so as to allow the cover part 6 to move between an open position and a closed position. The elongated flap 40 is connected to the inner side 42 of the rear surface 48 of the cover part 6 by an adhesive.

In order to save material for the cover part 6, it is desirable to use as thin a cardboard as possible, also because a thinner cardboard is more easily machine-handled into its desired shape. Thus, in order to provide an optimal trade-off between this and the need for a desired rigidity, the inner side of the top surface 14 of the cover 6 of the illustrated egg package 2 rests on the top 52 of the upwardly extending projections 36 of the bottom part 4 when the cover 6 is in the closed position. Without the upwardly extending projections 36 located between the rows of compartments 34 to support the cover 6 when the egg package 2 is closed, the weight of the additional egg-filled egg packages 2 will rest on the eggs of the lower packages in a stack, which may then break during storage and transport.

Figure 3C:
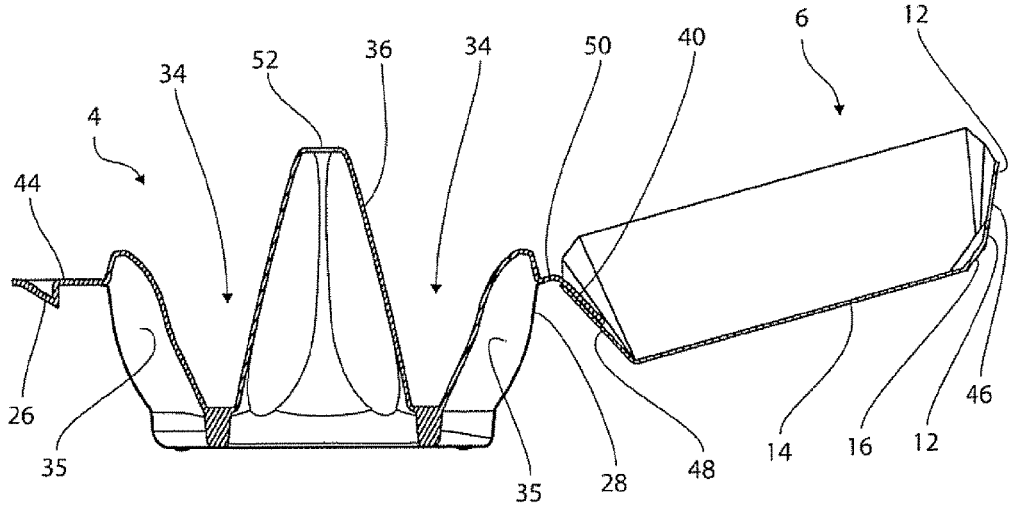
FIG. 3C shows a cross section of an egg package with an open cover.

FIG. 3C illustrates a cross section of the egg package 2 with the cover part 6 in its open position. In the illustrated embodiment, the elongated flap 40 is configured for abutting an egg within the egg package 2, and the retainment flap 44 is configured for abutting another egg within the egg package 2 when the cover part 6 is in its closed position. Hereby sufficient cushioning of the eggs is achieved, even along the back and front surfaces 48, 12 of the cover part 6.

As illustrated, the outwardly extending retainment projection 26 is tapered, whereby an ease of the closing and locking of the cover part 6 is achieved, because the front surface 12 of the cover part 6 (during closing) will slide over the retainment projection 26, whereby it will gradually bulge outwards until said projection 26 engages the co-operating aperture 46 in the front surface 12 of the cover part 6, whereupon the front surface 12 of the cover part 6 bulges back (due to the inherent rigidity of the cover material) to its original position and form, thereby keeping the cover 6 closed.

In order to ensure a safe and reliable locking of the cover part 6, the position, shape and size of the one or more co-operating apertures 46 in the front surface 12 of the cover part 6 correspond to the position, shape and size of the outwardly extending retainment projections 26.

With the illustrated egg package 2 is achieved an egg package 2 wherein the bottom part 4 is made of moulded fibrous material (preferably pulp), which provides a sufficient cushioning effect for the eggs to be transported in said egg package 2, and wherein the cover part 6 made of cardboard provides sufficient rigidity for the egg package 2 in order to ensuring safe handling of the egg packages 2 without a significant risk of breaking the eggs within said package 2.

Since the substantially flat display surface 16 meets the top surface 14 at a first obtuse angle, thereby forming a first edge 18, and said substantially flat display surface 16 meets the front surface 12 at a second obtuse angle, thereby forming a second edge 20, it is possible to close the cover part 6 by automated egg packaging machinery (working at a tremendous speed), because when the cover part 6 is pivoted with respect to the hinge 50 and moved from its open to its closed position, then the front surface 12 will slide over the at least one outwardly extending retainment projection 26 on the retainment flap 44 until said retainment projection 26 engages a co-operating aperture 46 in the front surface 12 of the cover part 6, thereby closing and locking the cover part 6. This error-free handling of the egg package 2 by packaging machinery is important because eggs and egg packages 2 are handled by packaging machinery at a tremendous speed.

Furthermore, since the cover 6 is made of cardboard, it has a surface that may easily be decorated and customized to the needs of the individual egg producer. Such decoration may be lithographic or text printed directly on the cover part. Compared to pulp or other fibrous material, cardboard is much easier to decorate with printed text and other decorations in any desirable colour.

Moreover, since the substantially flat display surface 16 meets the top surface 14 at a first obtuse angle, thereby forming a first edge 18, and the substantially flat display surface 16 meets the front surface 12 at a second obtuse angle, thereby forming a second edge 20, it is achieved that the substantially flat display surface 16 will be in the immediate line of vision of a person holding the egg package 2 in his hands (when the cover 6 is in the closed position). Thus, any message written on this display surface 16 will be more conspicuous than a message on any other surface of the cover part 6. A consumer in a supermarket is constantly bombarded with messages in written and lithographic form, and is usually also very busy. Thus, it is a tremendous advantage that an important message about the product (the eggs) can be conveyed to the consumer in a simple and conspicuous way, e.g. as a buss word like "Vegetarian feed", "Organic", "Omega 3", etc., thereby enabling the consumer to take a split-second decision on whether or not to buy the product.

Figure 4:
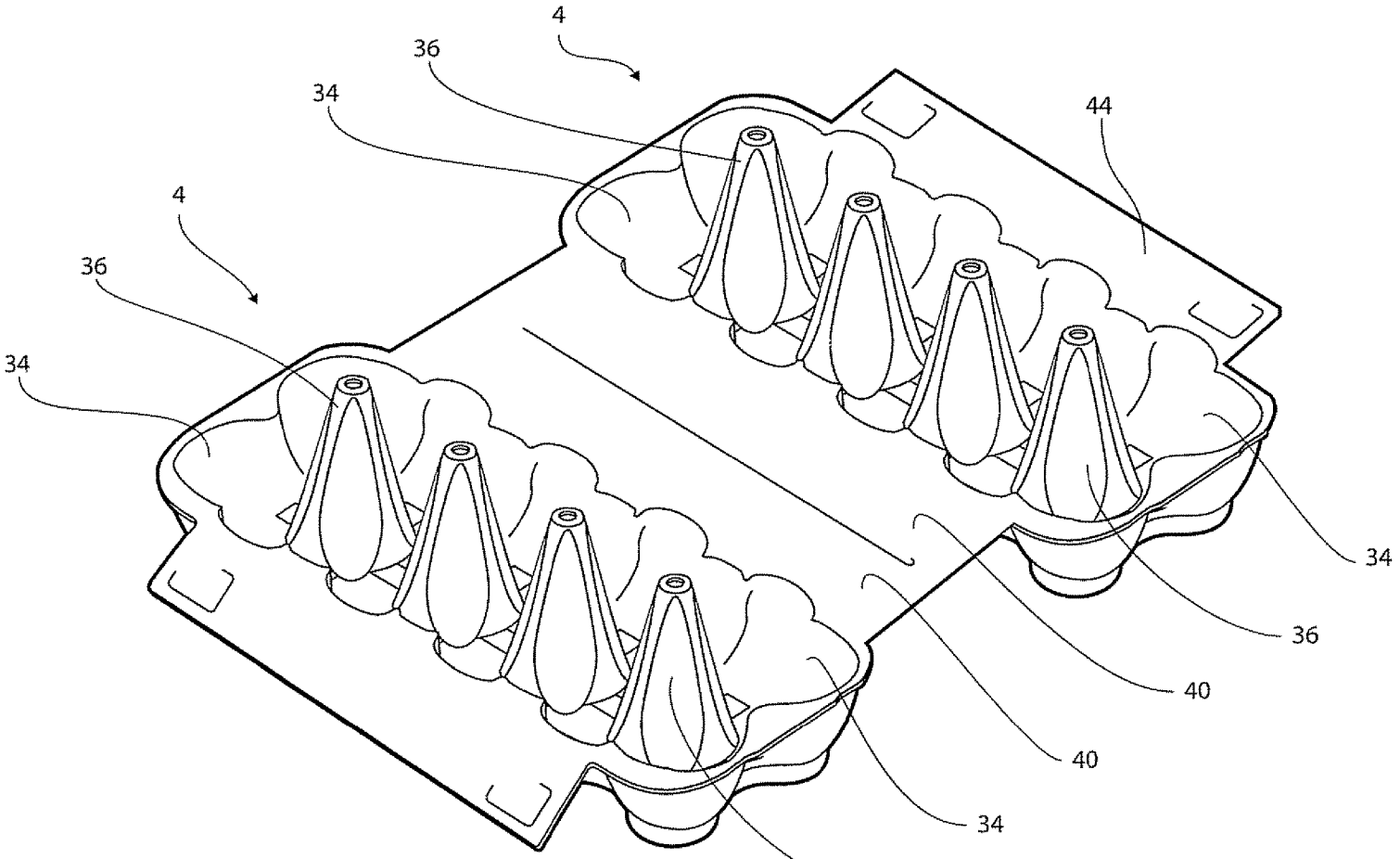
FIG. 4 shows two bottom parts moulded together.

As illustrated in FIG. 4, the bottom part 4 may be moulded as one piece together with another similar bottom part 4, the two bottom parts 4 being connected via the elongated flap 40. Hereby a simple way of manufacturing the bottom parts 4 may be achieved, which requires only a minimum degree of modification of already existing manufacturing equipment, because the part of a traditional moulding form, which is used to manufacture the cover part in traditional egg packages, may simply be exchanged with another form for the bottom part 4 according to the invention.

Figure 5:
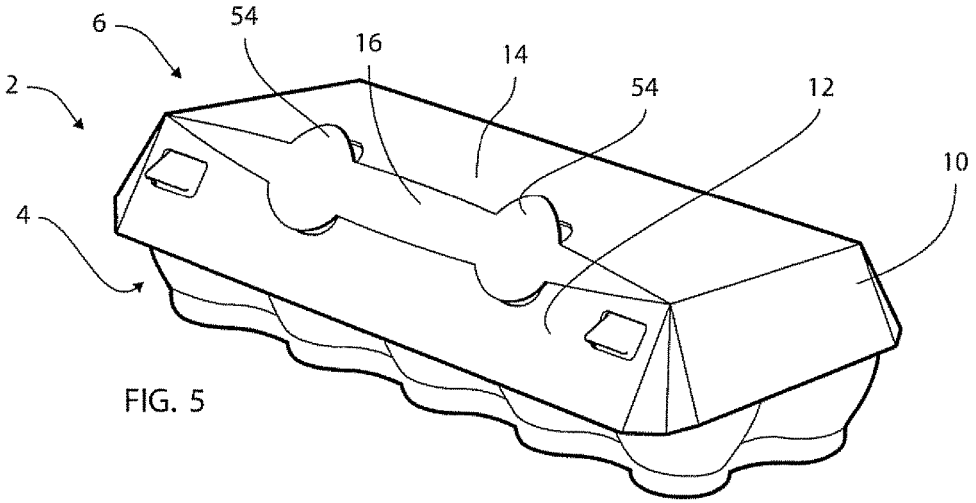
FIG. 5 is a perspective illustration of an alternative embodiment of an egg package according to the invention.

In FIG. 5 is illustrated an alternative embodiment of an egg package 2, wherein the substantially flat display surface 16 is provided with a physical feature 54 representing the contents of the egg package 2 in order to enhance the conspicuousness of said substantially flat display surface 16. The illustrated physical feature 54 extends beyond the substantially flat display surface 16. The physical feature 54 may partly be formed by a cutout from the top surface 14 of the cover part 6. This is a practical way of achieving facilitation of said physical feature 54. The physical feature 54 may also, or alternatively, be partly formed by a cutout from the front surface 12 of the cover part 6—or as illustrated—said physical feature 54 may be partly formed as a cutout from both the top surface 14 and the front surface 12.

In the illustrated embodiment, the physical feature 54 is formed as a two-dimensional representation of an egg, but it could alternatively be one or more egg shells, or a hen. Preferably, said physical feature 54 is customized, whereby it will be possible for individual egg producers to distinguish themselves from other producers in a more conspicuous way.

Figure 6:
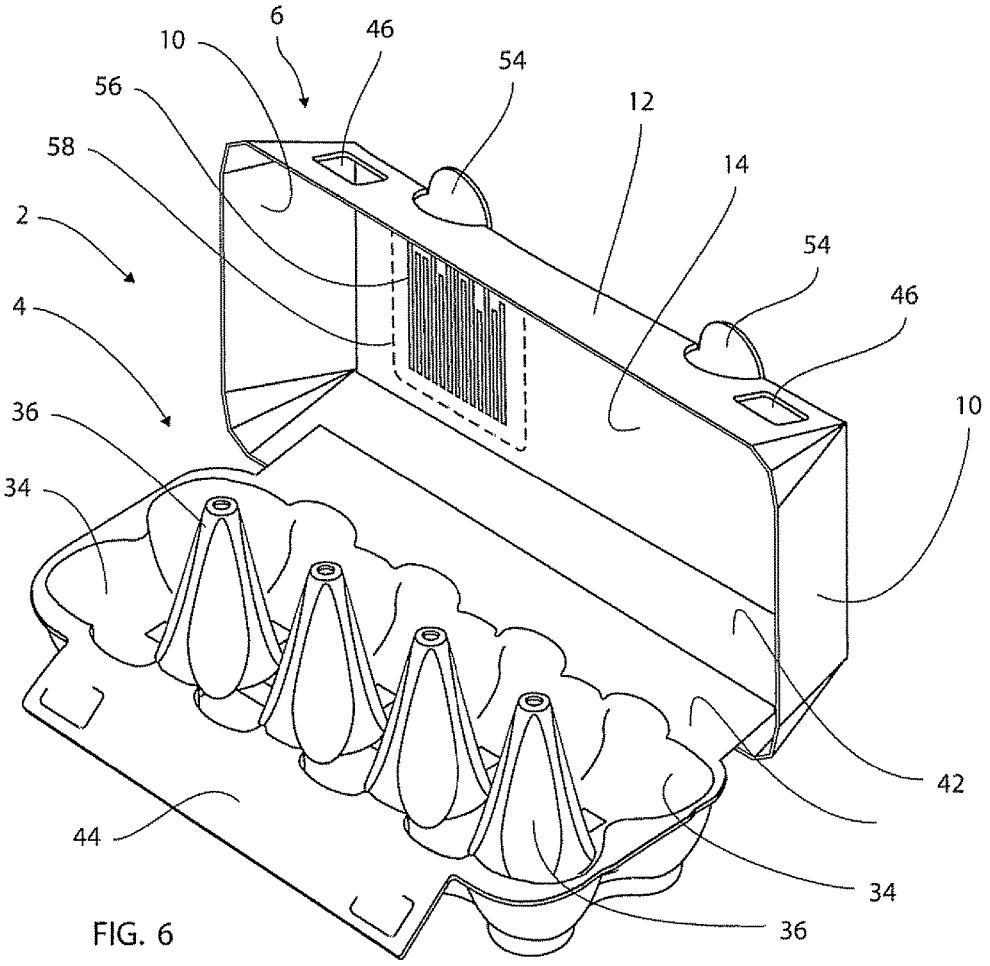
FIG. 6 shows the same embodiment of an egg package as illustrated in FIG. 5, but now in a state wherein the cover is open.

FIG. 6 shows the same embodiment of the egg package as illustrated in FIG. 5, but now with the cover 6 in the open position. In the illustrated embodiment, the inner side of the top surface 14 is provided with a recipe 56 and perforations 58 around the recipe 56. Hereby is achieved an embodiment wherein the consumer can easily remove the recipe 56 from the cover part 6 and save it for later use.

Figure 7:
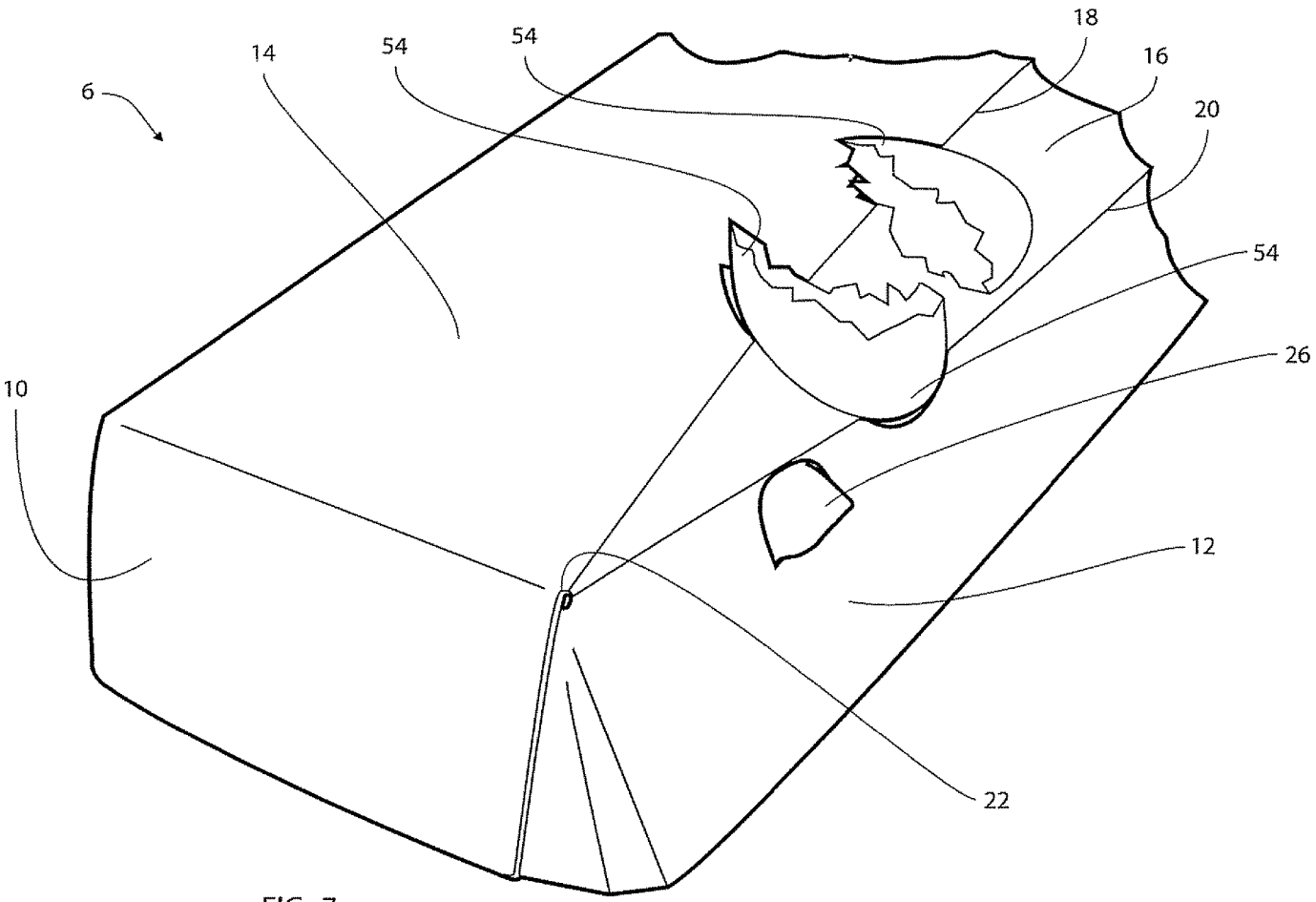
FIG. 7 shows a close-up view of a section of a cover part of an egg package according to a further embodiment of the invention.

FIG. 7 shows a close-up view of a section of a cover part 6 of an egg package 2 according to a further embodiment of the invention.

In this embodiment, the substantially flat display surface 16 comprises a physical feature 54, which is formed as two egg shells, wherein one of the egg shells is partly formed as a cutout from the top surface 14 and as a cutout from the front surface 12. The other egg shell is partly formed as a cutout from the top surface 14 only. The use of such a physical feature 54 is very conspicuous, and clearly conveys information to the consumer that the contents of the package 2 are eggs. Furthermore, this physical feature 54 is of such a shape and size that stacking of egg packages 2 on top of each other is possible.

In all of the illustrated embodiments of the invention, the cover part 6 may be provided with graphical and/or pictorial information which is directly printed onto said cover part 6. Preferably, the cover part 6 is customized. According to one embodiment of the egg package 2 according to the invention, the graphical and/or pictorial information which is directly printed on the cover part 6 is customized.

LIST OF REFERENCE NUMBERS

In the following is given a list of reference numbers that are used in the detailed description of the invention.

2 egg package,
4 bottom part,
6 cover part,
10 end surfaces of the cover part,
12 front surface of the cover part,
14 top surface of the cover part,
16 substantially flat display surface of the cover part,
18 first edge,
20 second edge,
22, 24 first and second corner of cover part,
26 outwardly extending retainment projection,
28 rear side of bottom part,
30 front side of bottom part,
32 end sides of bottom part,
34 egg-receiving compartments,
35 non-planar side surface of egg-receiving compartments,
36 upwardly extending projections located between the rows of egg-receiving compartments,
40 elongated flap,
42 inner side of the rear surface of the cover part,
44 retainment flap,
46 co-operating apertures in the cover part,
48 rear surface of cover part,
50 hinge,
52 top of the upwardly extending projections,
54 physical feature of the display surface,
56 recipe, and
58 perforations around the recipe.

The invention claimed is:

1. An egg package comprising:

a bottom part formed of a fibrous material, the bottom part comprising a rear side, a front side, two end sides, and a plurality of egg-receiving compartments having non-planar side surfaces so as to match at least partially the outer contours of an egg, the plurality of compartments being arranged in at least two parallel rows with upwardly extending projections located between the rows of compartments, a cover part comprising two substantially planar end surfaces, substantially planar rear and front surfaces, and a substantially planar top surface, said cover part being formed by cardboard and connected to the bottom part via an elongated flap extending from the rear side of the bottom part, said elongated flap being provided with a weakening in the transition between said elongated flap and rear side of the bottom part, said weakening forming a hinge so as to allow the cover part to move between an open position and a closed position, said elongated flap at least in part overlapping the inner side of said rear surface of the cover part, the front surface of the cover part extending downwardly to a lower edge, said bottom part comprising a retainment flap hinged to the front side of the bottom part, said retainment flap comprising at least one outwardly extending retainment projection for locking engagement with one or more co-operating apertures in the front surface of the cover part, wherein, said cover part further comprises a substantially flat display surface formed in the region between the top surface and said lower edge of the front surface, said substantially flat display surface meeting the top surface at a first obtuse angle, thereby forming a first edge, and said substantially flat display surface meeting the front surface at a second obtuse angle, thereby forming a second edge, the substantially flat display surface forming a panel which is bounded and enclosed by the first and second edges, and wherein the first edge curves upwardly, and the second edge curves downwardly.

2. An egg package according to claim 1, wherein the first and second edges meet at a first and second corner of the cover part.

3. An egg package according to claim 1, wherein the substantially flat display surface is provided with a physical feature representing the contents of the egg package, said physical feature extending beyond the substantially flat display surface (16) and partly being formed by a cutout from the top surface of the cover part.

4. An egg package according to claim 3, wherein the physical feature is formed as a two-dimensional representation of any of the following agricultural products: an egg, one or more egg shells, a hen.

5. An egg package according to claim 1, wherein the cover part is provided with a graphical and/or pictorial information, which is directly printed on said cover part.

6. A kit comprising:

a bottom part of an egg package, said bottom part being formed of a fibrous material and comprising a rear side, a front side, two end sides, and a plurality of egg-receiving compartments having non-planar side surfaces so as to match at least partially the outer contours of an egg, the plurality of compartments being arranged in at least two parallel rows with upwardly extending projections located between the rows of compartments, said bottom part comprising a retainment flap hinged to the front side of the bottom part, said retainment flap comprising at least one outwardly extending retainment projection for locking engagement with one or more co-operating apertures in a front surface of a cover part, a blank of cardboard material comprising preformed cutting and folding lines, the blank being configured such that, when cut and folded along said cutting and folding lines, it forms:

a cover part for said bottom part of an egg package, said cover part comprising two substantially planar end surfaces, substantially planar rear and front surfaces, and a substantially planar top surface, said cover part being connectable to the bottom part via an elongated flap extending from the rear side of the bottom part, said elongated flap being an integrally moulded part of said bottom part and being provided with a weakening in the transition between said elongated flap and rear side of the bottom part, said weakening forming a hinge so as to allow the cover part to move between an open position and a closed position, said elongated flap at least in part overlapping the inner side of said rear surface of the cover part, the front surface of the cover part extending downwardly to a lower edge, wherein, said cover part further comprises a substantially flat display surface being formed in the region between the top surface and the said lower edge of the front surface wherein said substantially flat display surface meets the top surface at a first obtuse angle, thereby forming a first edge, and wherein said substantially flat display surface meets the front surface at a second obtuse angle, thereby forming a second edge, the substantially flat display surface forming a panel which is bounded and enclosed by the first and second edges, and wherein the first edge curves upwardly, and the second edge curves downwardly.

7. A kit of parts according to claim 6, wherein the first and second edges of the cover part meet at a first and second corner of the cover part when the cardboard blank is cut and folded along the cutting and folding lines.

8. A kit of parts according to claim 6, wherein the substantially flat display surface is provided with a physical feature representing the contents of the egg package, said physical feature extending beyond the substantially flat display surface and partly being formed by a cutout from the top surface of the cover part.

9. A kit of parts according to claim 8, wherein the physical feature is formed as a two-dimensional representation of any of the following agricultural products: an egg, one or more egg shells, a hen.

10. A kit of parts according to claim 6, wherein the cardboard blank is provided with a graphical and/or pictorial information which is directly printed on said cardboard blank.

* * * * *